United States Patent [19]

Gartner et al.

[11] Patent Number: 4,829,965

[45] Date of Patent: May 16, 1989

[54] INJECTION VALVE FOR MIXTURE-COMPRESSING INTERNAL-COMBUSTION ENGINES, PARTICULARLY FOR A SINGLE SUCTION PIPE INJECTION

[75] Inventors: Jurij Gartner, Germering; Wolfgang Kaindl, Moosburg, both of Fed. Rep. of Germany

[73] Assignee: Bayerische Motoren Werke A.G., Munich, Fed. Rep. of Germany

[21] Appl. No.: 2,627

[22] PCT Filed: Apr. 2, 1985

[86] PCT No.: PCT/EP85/00149

§ 371 Date: Dec. 2, 1986

§ 102(e) Date: Dec. 2, 1986

[87] PCT Pub. No.: WO86/05845

PCT Pub. Date: Oct. 9, 1986

[30] Foreign Application Priority Data

Feb. 23, 1984 [DE] Fed. Rep. of Germany ..... 3406487
Dec. 2, 1984 [EP] European Pat. Off. ..... 85101463.9

[51] Int. Cl.[4] ..... F02M 61/14

[52] U.S. Cl. ..... 123/470; 239/288; 239/600

[58] Field of Search ..... 123/470, 471, 472; 239/600, 288, 288.3, 288.5, 397.5, 533.2–533.12

[56] References Cited

U.S. PATENT DOCUMENTS 4,589,596 5/1986 Stumpp et al. ..... 239/397.5
4,647,012 3/1987 Gartner ..... 123/470 X

FOREIGN PATENT DOCUMENTS 2824476 12/1979 Fed. Rep. of Germany ..... 123/470
3406487 8/1985 Fed. Rep. of Germany ..... 123/470

*Primary Examiner*—Tony M. Argenbright
*Assistant Examiner*—Eric R. Carlberg
*Attorney, Agent, or Firm*—Barnes & Thornburg

[57] ABSTRACT

An injection valve for a single suction pipe injection in the case of mixture-compressing internal-combustion engines on the ejection side by an insertion connection by means of a nozzle part is held in a wall breakthrough of the suction pipe, having a rubber elastic O-ring located in-between. In order to avoid damage to the O-ring, when the injection valve is inserted, at the processing edges of the wall breakthrough, a centering device is arranged in the free end area of the nozzle part. Preferably, the centering device is developed at a protective cap that can be arranged in the free end area of the nozzle piece.

3 Claims, 2 Drawing Sheets

INJECTION VALVE FOR MIXTURE-COMPRESSING INTERNAL-COMBUSTION ENGINES, PARTICULARLY FOR A SINGLE SUCTION PIPE INJECTION

The invention relates to an injection valve according to the construction of the introductory part of the main claim.

In the case of this known construction, the O-ring arranged on the nozzle of the injection valve is pressed radially during the insertion into the receiving bore in the suction pipe wall. On the insertion side, the receiving bore has a bevel by means of which the pressing of the O-ring is introduced during the insertion into the receiving bore. For structural reasons, this bevel, in the area around the receiving bore, as a rule is relatively low in inserting direction and is formed at a relatively large cone angle. At the transition from the receiving bore to the bevel, this results in a relatively sharp edge which, when the nozzle part of the injection nozzle is connected eccentrically with respect to the receiving bore, may result in damage to the O-ring.

In the case of the simultaneous mounting of several injection valves at the single suction pipes of a suction system for in-line cylinders of an internal-combustion engine, this danger is particularly great when the injection valves, on the fuel supply side, are arranged at a joint fuel distributor pipe (DE-OS No. 29 26 490). In this case, for the tuning-out of noise between the injection valves and the fuel distributor pipe, a respective insertion arrangement is provided with an inserted sealing ring, similar to the above-described insertion arrangement on the side of the suction pipe. By means of this insertion arrangement, each injection valve to a certain degree can be removed relative to the fuel distributor pipe so that during the simultaneous mounting of the injection valves, eccentric positions of some injection valves with respect to their receiving bores must be expected.

The invention is based on the objective of indicating a development of an injection valve of the initially mentioned construction by means of which, when the injection valve is inserted into the receiving bore of the suction pipe, damage to the sealing ring is avoided.

This objective is achieved by the characterizing part of the main claim containing a centering device arranged in the free end area of the nozzle. Advantageous developments of the invention are described in claims 2 and 3. In the case of both developments, the invention is in each case carried out on the basis of a protective cap for the nozzle piece of the injection valve known in the state of the art. The inventive development of the protective caps that are preferably made of plastic consists of the elastically flexible outside contour provided by additional arrangements. As a result, the automatic centering of the injection nozzle is advantageously supported. In addition, this outside contour provided by means of elastically flexible tongues or flexible lips at webs, with its dimensions with respect to the receiving bores, combines an automatic advancing of the nozzle piece of the injection valve into the receiving bore with the avoidance of damage to the sealing ring at the processing edges.

Embodiments of the invention are shown in the drawing.

Figure 1:
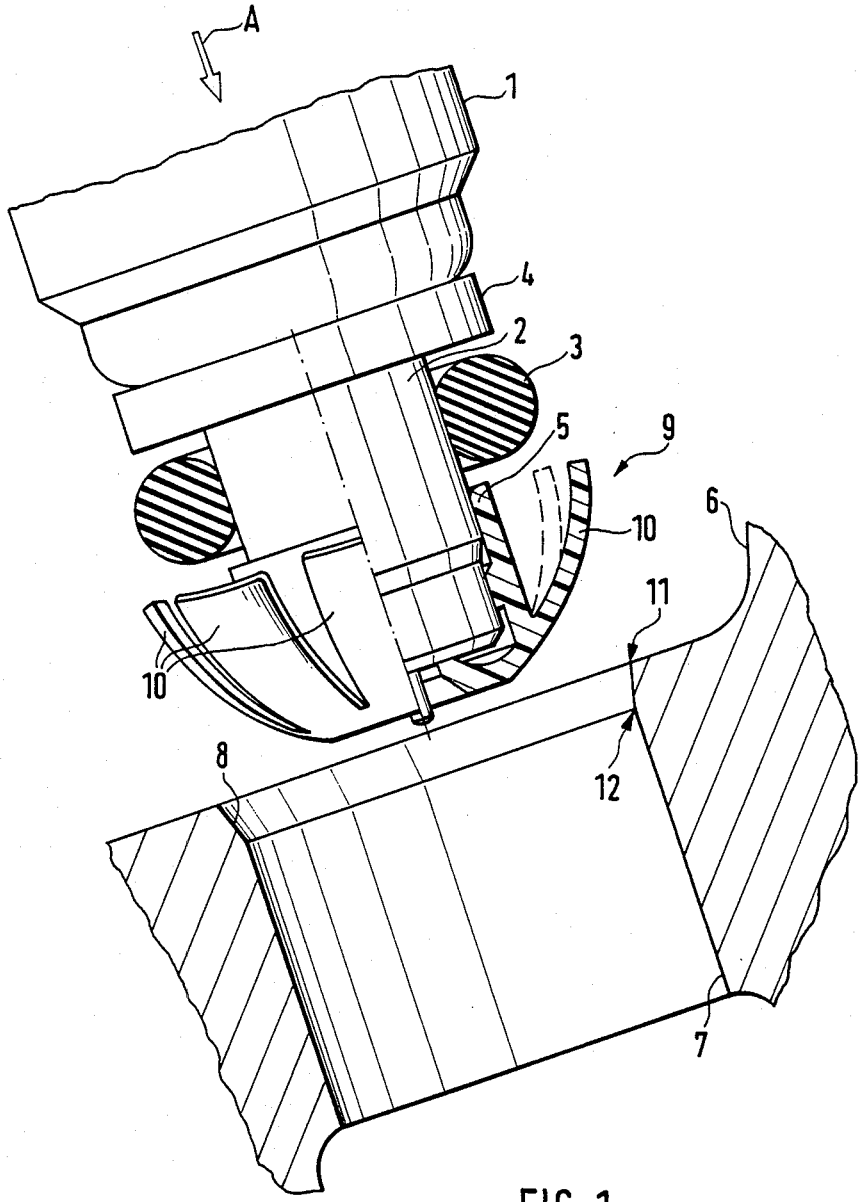
FIG. 1 is a partially shown injection valve having a protective cap that has an approximately semispherical elastic outside contour formed by flexible tongues.

An injection valve 1 for a mixture-compressing internal-combustion engine that is not shown carries an O-ring on a nozzle piece 2. The O-ring 3 is arranged on the nozzle piece 2 between a shoulder 4 of the injection valve 1 and a protective cap 5 in the free end area of the nozzle piece 2. For the holding of the injection valve 1 in a suction pipe 6, the injection valve 1, with its nozzle piece 2, is inserted into a wall breakthrough 7 of the suction pipe 6, the holding of the injection valve 1 being achieved essentially by the compressed O-ring 3 between the wall breakthrough 7 and the nozzle piece 2. The wall breakthrough or receiving bore 7, on the insertion side, has a bevel 8.

By means of a centering device 9 at the protective cap 5, it is ensured that the injection valve 1, at the start of the inserting process, is centered in the receiving bore 7 and, during the continued inserting until the O-ring 3 rests against the bevel 8, is guided centrically. The centering device 9 comprises tongues 10 shaped onto the protective cap 5 made of plastic, said tongues 10 being elastically flexible transversely to the inserting direction—Arrow A—of the injection valve 1 and having an outside contour that is located in the shell surface of a half sphere. In addition, the edge areas of the not deformed tongues 10 are located on a diameter that corresponds at least to the outer diameter of the uncompressed O-ring 3. By means of this development of the centering device 9, an eccentric position of the nozzle piece 2 of the injection valve 1 during insertion is avoided and a possible damaging of the rubber-elastic O-ring 3 at the processing edges 11 and 12 is prevented.

Figure 2:
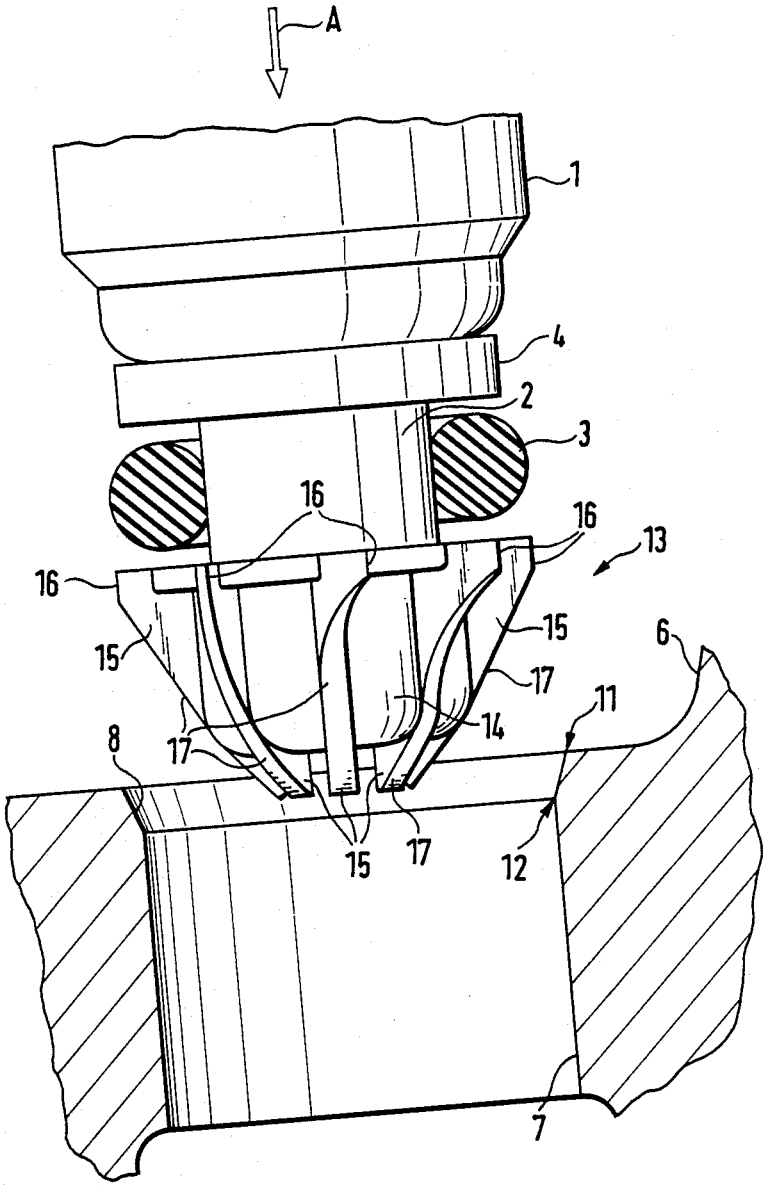
FIG. 2 is a partially shown injection valve having a protective cap that has webs distributed at the outer circumference that, in each case, in the area of the large outer diameter taper off into lips that are elastically flexible in circumferential direction.

In the embodiment according to FIG. 2, identical parts have the same reference numbers as in FIG. 1. A centering device 13 comprises webs 15 arranged at the outer circumference of a protective cap 14, said webs 15 having an outside contour located in the shell surface of a cone. These webs 15, with an increasing diameter, in each case, change from a rectangular cross-section into a sickle-shaped or crescent-shaped cross-section. At the protective cap 14 made of an elastic material, the free ends of the sickle-shaped cross-sections, in circumferential direction, form elastically flexible lips 16. The undeformed lips 16 at the webs 15 are inscribed in a diameter that corresponds to the diameter of the uncompressed O-ring 3. The webs 15, with their ramps 17 that are located on the shell surface of a relatively slender cone, significantly facilitate the threading of the injection valve 1 into the receiving bore 7, by means of which the self-centering of the injection valve 1 is also improved. When the injection valve 1 is inserted into the receiving bore 7 of the suction pipe 6, the lips 16 at the webs 15, by means of the sickle-shaped cross-section, place themselves against the wall of the receiving bore 7. By matching the course of the sickel-shaped cross-section, the extent of the flexibility of the lips 16 can be determined and thus their flexibility transversely to the inserting direction Arrow A. When the sickel-shaped cross-section and the material of the webs 15 and the protective cap 14 are matched, a secure centering can be achieved with the smallest possible lateral offset when the injection valve 1 is inserted into the receiving bore 7. The smaller the lateral offset permitted by the centering device 13 by means of the lips 16, the less is the danger of damage to the O-ring 3 at the processing edges 12 and 11 when the injection valve 1 is mounted in the receiving bore 7 of the suction pipe 6.

We claim:

1. An injection valve for mixture-compressing internal-combustion engines, particularly for a single suction pipe injection, that, on the ejection side, by an insertion connection by means of a nozzle part is held in a wall breakthrough of the suction pipe, having a rubber-elastic sealing O-ring located in-between, characterized in that a centering device is arranged in the free end area of the nozzle piece.

2. An injection valve according to claim 1, having a protective cap in the free end area of the nozzle piece, characterized in that tongues are arranged at the protective cap that are elastically flexible transversely to the inserting direction of the injection valve and have an outer contour located in the shell surface of a half sphere or of a cone, the free edge areas of the tongues being located on a diameter that corresponds at least to the outside diameter of the uncompressed O-ring.

3. An injection valve according to claim 1, having a protective cap 14 in the free end area of the nozzle piece 2, characterized in that webs 15 are arranged at the outer circumference of the protective cap 14 that have an outer contour located in the shell surface of a cone or of a half sphere and, with an increasing diameter, in each case, change into a sickle-shaped cross-section, the free ends of the sickle-shaped cross-section, in circumferential direction, forming elastically flexible lips 16 that are inscribed in a diameter that at least corresponds to the outside diameter of the uncompressed O-ring 3.

* * * * *